US008998175B2

(12) United States Patent
Graber

(10) Patent No.: US 8,998,175 B2
(45) Date of Patent: Apr. 7, 2015

(54) RAIL CROSSOVER

(75) Inventor: Loren R. Graber, Nappanee, IN (US)

(73) Assignee: Digger Specialities, Inc., Breman, IN (US)

( * ) Notice: Subject to any disclaimer, the term of this patent is extended or adjusted under 35 U.S.C. 154(b) by 0 days.

(21) Appl. No.: 13/274,985

(22) Filed: Oct. 17, 2011

(65) Prior Publication Data

US 2012/0032130 A1 Feb. 9, 2012

Related U.S. Application Data

(62) Division of application No. 12/568,982, filed on Sep. 29, 2009, now abandoned.

(60) Provisional application No. 61/100,885, filed on Sep. 29, 2008.

(51) Int. Cl.
*E04H 17/00* (2006.01)
*E04F 11/18* (2006.01)

(52) U.S. Cl.
CPC ..... *E04F 11/1836* (2013.01)

(58) Field of Classification Search
CPC ..... E04F 11/1808; E04F 11/1836; E04F 11/1812; E04H 17/1421; E04H 17/1413; E04H 17/1434; E04H 17/1443; E04H 17/20
USPC ..... 256/21, 65.15, 65.02, 65.07, 65.08
See application file for complete search history.

(56) References Cited

U.S. PATENT DOCUMENTS

| | | | | | |
|---|---|---|---|---|---|
| 3,333,823 | A * | 8/1967 | Genauer et al. | ..... | 256/65.08 |
| 3,385,567 | A * | 5/1968 | Case et al. | ..... | 256/24 |
| 3,491,984 | A * | 1/1970 | Nyberg | ..... | 256/21 |
| 3,498,589 | A * | 3/1970 | Murdock | ..... | 256/70 |
| 3,506,243 | A * | 4/1970 | Seiler | ..... | 256/59 |
| 4,892,292 | A * | 1/1990 | Russell | ..... | 256/66 |
| 5,029,818 | A * | 7/1991 | Katz | ..... | 256/22 |
| 5,370,368 | A * | 12/1994 | Terrels et al. | ..... | 256/19 |
| 6,637,728 | B2 * | 10/2003 | Pettit et al. | ..... | 256/19 |
| 7,243,473 | B2 * | 7/2007 | Terrels | ..... | 52/843 |
| 7,540,472 | B2 * | 6/2009 | Striebel et al. | ..... | 256/67 |
| 7,641,180 | B2 * | 1/2010 | Adderton | ..... | 256/67 |
| 7,967,522 | B2 * | 6/2011 | Goad | ..... | 403/292 |
| 2006/0175594 | A1 * | 8/2006 | Burkart et al. | ..... | 256/65.02 |
| 2007/0029534 | A1 * | 2/2007 | Adderton | ..... | 256/24 |
| 2008/0265232 | A1 * | 10/2008 | Terrels et al. | ..... | 256/65.04 |

* cited by examiner

*Primary Examiner* — Daniel P Stodola
*Assistant Examiner* — Jonathan Masinick
(74) *Attorney, Agent, or Firm* — Barnes & Thornburg LLP

(57) ABSTRACT

A railing assembly that, in one embodiment, includes a first rail, a second rail, and a post that are coupled with a rail crossover assembly. The rail crossover assembly may include a first end with a first flange configured to be received in a cavity of the first rail, a second end with a second flange configured to be received in a cavity of the second rail, and a post coupling member configured to be received in a cavity of the post. The first end, the second end and the third end of the rail crossover assembly are oriented so the post is substantially orthogonal with respect to the first rail and the second rail.

13 Claims, 4 Drawing Sheets

RAIL CROSSOVER

RELATED APPLICATION

This is a divisional application of U.S. Utility application Ser. No. 12/568,982, filed on Sep. 29, 2009, entitled "Rail Crossover" which claimed the benefit of U.S. Provisional Application No. 61/100,885 filed Sep. 29, 2008, entitled "Rail Crossover," the entire disclosures of which is hereby incorporated by reference.

TECHNICAL FIELD

The present invention relates generally to fences and railing assembly and more particularly to a rail crossover that could be used to couple rails with a post.

BACKGROUND

Railing assemblies on various structures, such as porches and decks, act as a boundary to prevent persons from inadvertently falling off. The railing assembly typically has a plurality of spaced-apart vertical posts interconnected by rails. Rails and posts have been secured together using a number of different techniques. There remains a need, however, for a novel device for coupling rails and posts in a more efficient manner.

SUMMARY

According to one aspect, the invention provides a railing assembly with a first rail defining a longitudinally extending cavity, a second rail defining a longitudinally extending cavity, and a post defining a longitudinally extending cavity. A rail crossover assembly may be provided for coupling the rails and post so the post is substantially orthogonal with respect to the first rail and the second rail. The rail crossover assembly may include a first end with a first flange configured to be received in the cavity of the first rail and a second end with a second flange configured to be received in the cavity of the second rail. A post coupling member may be provided that is configured to be received in the cavity of the post.

In one embodiment, a first ridge may extend into the cavity of the first rail, which could be received by a slot defined in the first flange. In some cases, a second ridge may extend into the cavity of the second rail. The second flange could include a slot dimensioned to receive the second ridge. Additional ridges could extend into the cavities of the rails and additional slots could be provided in the flanges to receive the slots.

In some embodiments, the exterior surface of the first rail and the rail crossover assembly could have a substantially uninterrupted exterior surface contour when they are coupled together. Likewise, in some embodiments, the exterior surface of the second rail and the rail crossover assembly could have a substantially uninterrupted exterior surface contour when coupled together.

Embodiments are contemplated in which the rail crossover assembly may include side walls extending between an upper wall and a lower wall. In some cases, a platform could extend from the lower wall for supporting the first rail. Depending on the situation, the platform may define an opening dimensioned to receive a fastener for coupling the first rail to the platform. Depending on the particular application, the upper wall may have an arcuate shape. In some cases, the side walls and/or the lower wall may have a substantially planar shape.

In one example embodiment, the first flange may include a first segment extending between a second segment and a third segment. In some cases, at least a portion of the first segment is arcuate in shape. In some cases, the first segment, the second segment and/or the third segment include slot(s) for receiving ridge(s) extending from the first rail.

According to another aspect, the invention provides a rail crossover assembly. In some cases, the assembly may include a rail coupling member with a first end configured to receive a first rail and an opposing second end configured to receive a second rail. A base portion may be provided with a platform adapted to support the first rail and the second rail. Typically, the platform extends from the first end and the second end of the rail coupling member. The assembly may include a post coupling member extending from the base portion and adapted to be coupled with a post.

Embodiments are contemplated in which the rail crossover assembly may include a first flange extending from the first end of the rail coupling member and a second flange extending from the second end of the rail coupling member. In some cases, the first flange may include a first segment, a second segment, and a third segment. In one embodiment, at least a portion of the first segment is arcuate in shape. The second segment and the third segment could be approximately planar in shape. In some embodiments, the first segment, the second segment and/or the third segment may include slot(s) for receiving a portion of the first rail.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
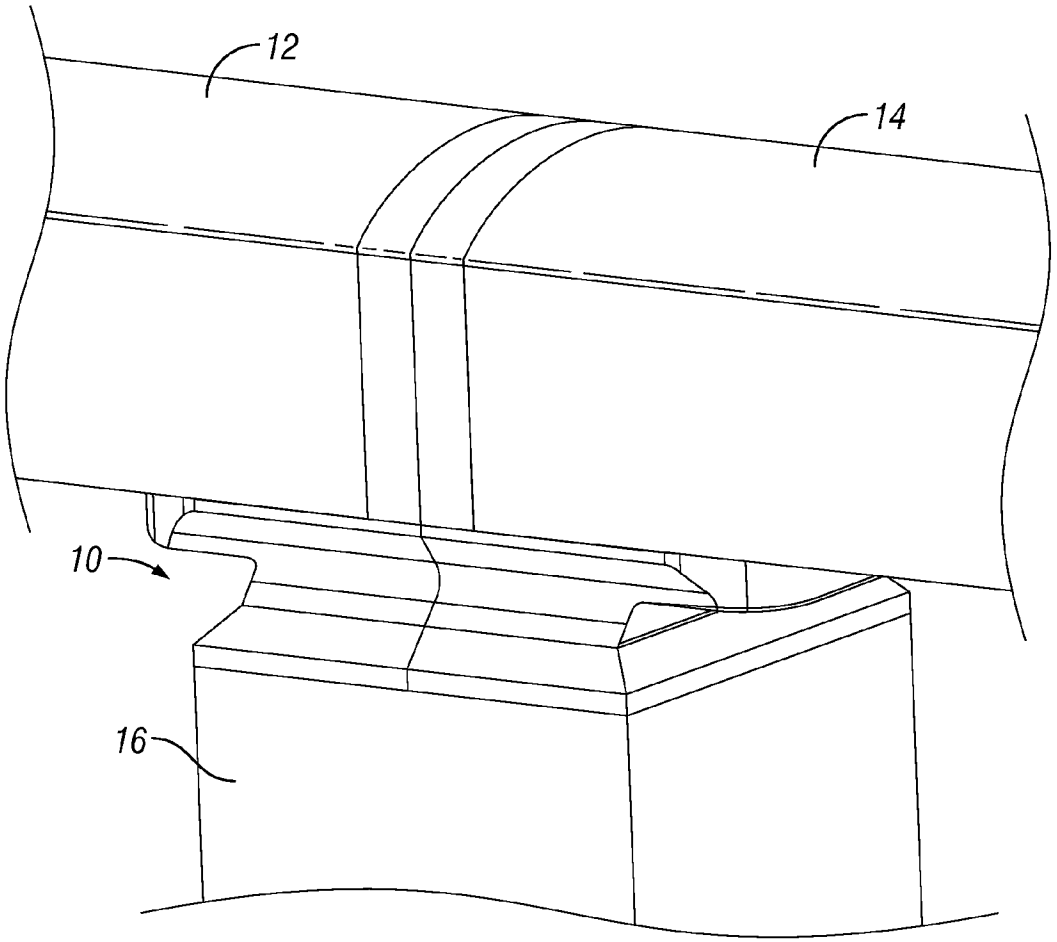
FIG. 1 is a perspective view showing an example crossover assembly according to an embodiment of the invention that is coupled with a first rail, a second rail and a post.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

FIG. 1 shows an example embodiment of a rail crossover assembly 10 coupled with a first rail 12, a second rail 14, and a post 16. As used herein, the term "coupled" is broadly intended to encompass both direct and indirect connections. As shown, the rails 12, 14 extend orthogonally from the rail crossover assembly 10 with respect to the post 16. Typically, the post 16 may be oriented vertically and the rails oriented horizontally. As shown, the rail crossover assembly and rails 12, 14 are coupled such that their exterior surface contours are substantially uninterrupted. Embodiments are contemplated in which the rail crossover assembly 10, rails 12, 14 and post 16 may be formed from a metal including but not limited to aluminum and/or steel. In some embodiments, the rail crossover assembly 10, rails 12, 14 and post 16 may be formed from polyvinyl chloride ("PVC") resin. One skilled in the art should appreciate that other suitable materials could be used for the rail crossover assembly 10, rails 12, 14 and post 16.

Figure 2:
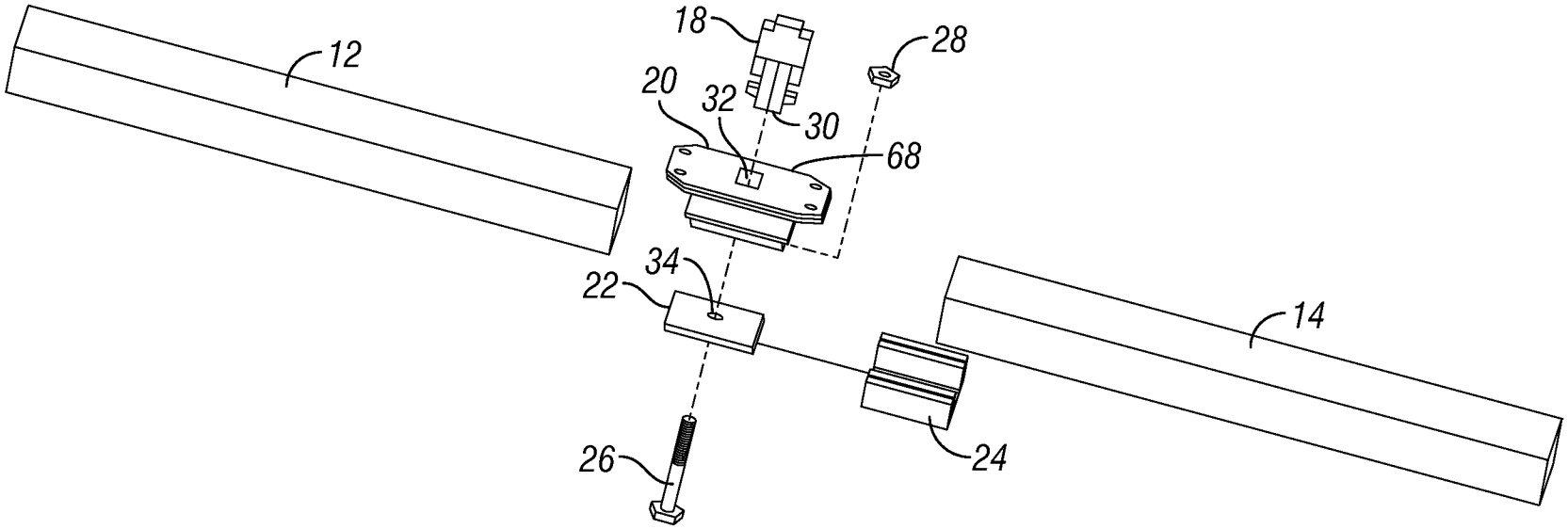
FIG. 2 is an exploded view showing an example embodiment of a crossover rail prior to mounting with a first rail and a second rail according to an embodiment of the invention.

FIG. 2 is an exploded view of the example rail crossover assembly 10 and the rails 12, 14. In the example shown, the rail crossover assembly 10 includes a rail coupling member 18, a base portion 20, a plate 22, a post coupling member 24, a bolt 26, and a nut 28. In this example, the rail coupling member 18 includes a tab 30 that is received by an opening 32 in the base portion 20. As shown, the plate 22 includes a hole 34 that is dimensioned to receive the bolt 26. Likewise, as shown, the opening 32 is dimensioned to receive the bolt 26. Additionally, the tab 30 may include a passage (not shown) through which the bolt 26 may extend. Typically, the post coupling member 22 would be received by a post 16; in this manner, the rail crossover 10 couples the rails 12, 14 to a post 16. The example construction of the rail crossover assembly 10 is shown for example purposes only. Although the example rail crossover assembly 10 has multiple components, it should be appreciated by one skilled in the art that the rail crossover assembly 10 could be formed from a unitary member; likewise, multiple components could be combined into a unitary member and those combined components coupled together. Although the bolt 26 and nut 28 are shown as example fasteners for purposes of example, it should be appreciated that other fasteners could be provided to couple various components of the rail crossover assembly 10.

Figure 3:
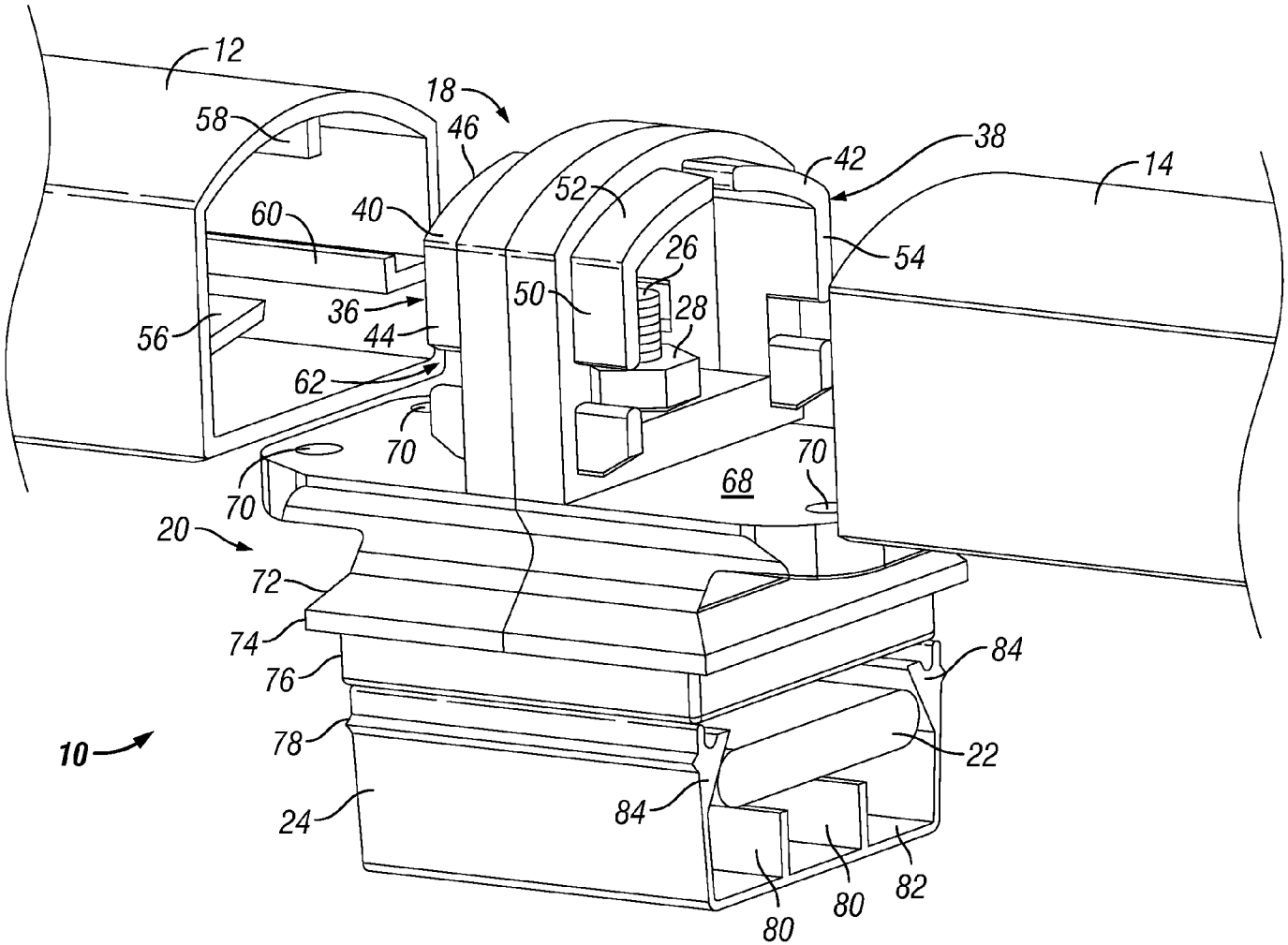
FIG. 3 is a perspective view of the crossover rail shown in FIG. 2 in an assembled state prior to mounting a first rail and second rail.
Figure 4:
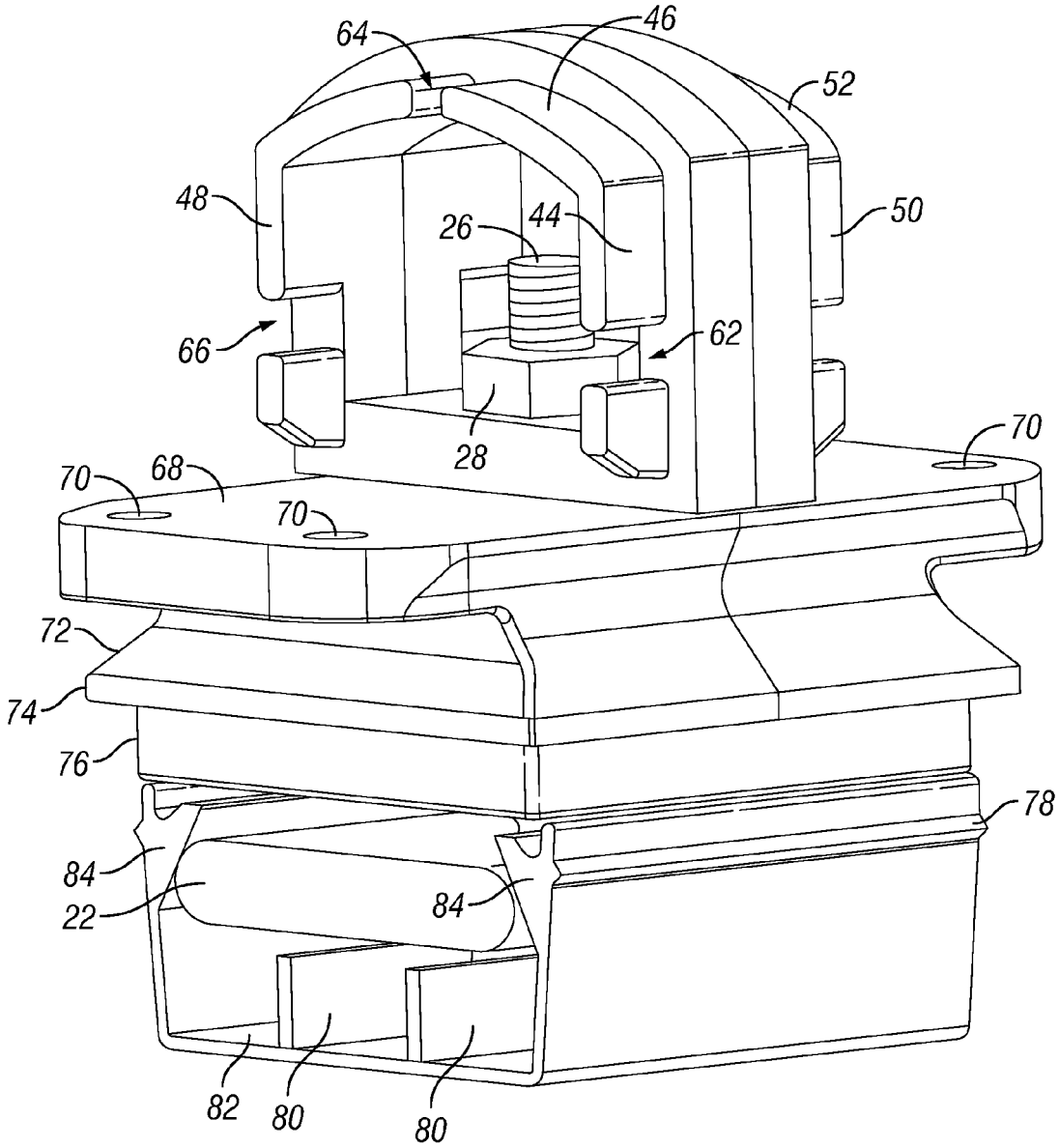
FIG. 4 is a perspective view of the rail crossover shown in FIG. 2.

FIGS. 3 and 4 show the example rail crossover assembly 10 in an assembled state. In the example shown, the rail coupling member 18 includes a first end 36 and a second end 38. As shown, a first flange 40 extends from the first end 36 and a second flange 42 extends from the second end 38. In this example, the flanges 40, 42 are received in the rails 12, 14, respectively. In the example shown, the first flange 40 includes a first segment 44, a second segment 46, and a third segment 48 and the second flange 38 includes a first segment 50, a second segment 52, and a third segment 54. In this example, the second segment 46 is arcuate in shape, while the first and third segments 44, 48 are substantially planar to correspond with the internal periphery of the rails 12, 14. It should be appreciated that the flanges 40, 42 could include a single segment or more than three segments.

In one embodiment, the rails 12, 14 may include one or more internal ridges that are received by one or more corresponding slots defined in the flanges 40, 42 of the rail coupling member 18. As shown in the example, the first rail 12 includes a first ridge 56, a second ridge 58, and a third ridge 60 that correspond to and are received by a first slot 62 defined in the first segment 44, a second slot 64 defined in the second segment 46, and a third slot 66 defined in the third segment 54.

As shown, the base portion 20 includes a platform 68 extending from the first and second ends 36, 38 of the rail coupling member 18. The platform 68 supports the rails 12, 14 when they are coupled with the rail coupling member 18. In this example, the platform 68 defines holes 70 through which fasteners, such as screws, could extend to couple the rails 12, 14 to the base portion 20. As shown the base portion 20, the platform extends through a tapered portion 72 to a collar 74. In this example, the base portion 20 includes a reduced dimension lower portion 76 with a substantially similar exterior dimension as the lower member 24. The post coupling member 24 extends from the lower portion 76 of the base portion 20. In the embodiment shown, the post coupling member 24 has a tapered shape to provide a frictional fit with the post 16. As shown, the post coupling member 24 includes a rib 78 to increase friction between the post coupling member 24 and the post 16. The plate 22 is received by the post coupling member 24. In the example shown, the lower portion includes ridges 80 that suspend the plate 20 above a bottom wall 82 of the post coupling member 24. As shown, the post coupling member 24 includes a reduced dimension area via an internally-extending wall 84 that is configured to hold the plate 22 substantially in place.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A rail crossover assembly comprising:

a rail coupling member with a first end configured to be coupled with a first rail and an opposing second end configured to be coupled with a second rail, wherein the rail coupling member includes a first flange projecting outwardly from the first end of the rail coupling member and a second flange projecting outwardly from the second end of the rail coupling member, wherein the first flange projects outwardly from the rail coupling member in a direction opposite the second flange, wherein the first flange and the second flange each have a generally hollow cross-sectional shape along a cross-sectional axis approximately transverse to a longitudinal axis of the rails, wherein the hollow cross-sectional shape includes a cavity defined by at least a first ridge, a second ridge and a third ridge each projecting outwardly from the rail coupling member along a longitudinal axis of the rails, wherein the first ridge and third ridge are spaced apart by the cavity and are approximately parallel with respect to each other, wherein the second ridge has an arcuate shape corresponding with an arcuate portion of an internal cavity in the first rail and the second rail into which the first flange and the second flange, respectively, are configured to be received, wherein the rail coupling member has a proximal end with a tab and the arcuate-shaped second ridge on a distal end, and wherein the first ridge and third ridge extend between the tab and the second ridge;

a base portion with a platform adapted to support the first rail and the second rail, wherein the platform includes a first portion that projects outwardly along a longitudinal axis of the rails from the first end and a second portion that projects outwardly along a longitudinal axis of the rails from the second end of the rail coupling member, wherein the first portion and the second portion extend outwardly along a longitudinal axis of the rails from the rail coupling member beyond the first flange and the second flange, respectively, wherein the platform defines a central opening dimensioned to receive the tab of the rail coupling member; and a post coupling member extending from the base portion and adapted to be coupled with a post, wherein the post coupling member is attached to the base portion using a fastener that extends through the central opening in the platform.

2. The rail crossover assembly of claim 1, wherein at least one of the first ridge, the second ridge and the third ridge include a slot for receiving a portion of the first rail.

3. The rail crossover assembly of claim 1, wherein the platform defines a first hole for receiving a fastener to connect the platform to the first rail and a second hole for receiving a fastener to connect the platform to the second rail, wherein the central opening is disposed between the first hole and the second hole.

4. The rail crossover assembly of claim 1, wherein the post coupling member includes tapered side walls.

5. The rail crossover assembly of claim 4, wherein the side walls include a rib on an external surface configured to frictionally engage a post.

6. The rail crossover assembly of claim 1, further comprising a plate received by the post coupling member, wherein the plate defines an opening coaxial with the central opening in the platform that is dimensioned to receive a fastener for attaching the post coupling member to the base portion.

7. The rail crossover assembly of claim 1, wherein the tab defines an opening that receives the fastener extending through the central opening in the platform.

8. A rail crossover assembly comprising:

a rail coupling member with a first end configured to be coupled with a first rail and an opposing second end configured to be coupled with a second rail, wherein the rail coupling member is interposed between the first rail and the second rail when the first rail and second rail are coupled to the rail coupling member, wherein an external surface of a top of the portion of the rail coupling member interposed between the first rail and second rail forms a substantially continuous and uninterrupted exterior surface contour with a top of the first rail and a top of the second rail when the rail coupling member is coupled with the first rail and the second rail, wherein the rail coupling member includes a first flange projecting outwardly from the first end of the rail coupling member and a second flange projecting outwardly from the second end of the rail coupling member, wherein the first flange projects outwardly from the rail coupling member in a direction opposite the second flange, wherein the first flange and the second flange each have a generally hollow cross-sectional shape along a cross-sectional axis approximately transverse to a longitudinal axis of the rails, wherein the hollow cross-sectional shape includes a cavity defined by at least a first ridge, a second ridge and a third ridge, wherein the first ridge and third ridge are spaced apart by the cavity and are approximately parallel with respect to each other, wherein the rail coupling member has a proximal end with a tab and a distal end;

a base portion with a platform adapted to support the first rail and the second rail, wherein the platform extends from the first end and the second end of the rail coupling member, wherein the platform defines a central opening dimensioned to receive the tab of the rail coupling member; and a post coupling member extending from the base portion and adapted to be coupled with a post, wherein the post coupling member is attached to the base portion using a fastener that extends through the central opening in the platform.

9. The rail crossover assembly of claim 8, wherein at least one of the first ridge, the second ridge and the third ridge include a slot for receiving a portion of the first rail.

10. The rail crossover assembly of claim 8, wherein the platform extends outwardly along a longitudinal axis of the rails from the rail coupling member beyond the first flange and the second flange.

11. The rail crossover assembly of claim 10, wherein the post coupling member includes tapered side walls.

12. The rail crossover assembly of claim 11, wherein the side walls include a rib on an external surface configured to frictionally engage an interior cavity of a post.

13. The rail crossover assembly of claim 12, wherein the platform defines a hole for receiving a fastener.

* * * * *